United States Patent [19]

Stahlecker et al.

[11] Patent Number: 4,835,957

[45] Date of Patent: Jun. 6, 1989

[54] OPEN-END SPINNING MACHINE

[76] Inventors: Fritz Stahlecker, Josef-Neidhart-Strasse 18, 7347 Bad Überkingen; Hans Stahlecker, Haldenstrasse 20, 7334 Süssen, both of Fed. Rep. of Germany

[21] Appl. No.: 119,032

[22] Filed: Nov. 10, 1987

[30] Foreign Application Priority Data

Nov. 22, 1986 [DE] Fed. Rep. of Germany ..... 3640001
Feb. 25, 1987 [DE] Fed. Rep. of Germany ..... 3705924

[51] Int. Cl.[4] ..... D01H 11/00; D01H 7/885

[52] U.S. Cl. ..... 57/301; 57/304; 57/401; 57/411

[58] Field of Search ..... 57/301, 304, 308, 401, 57/411, 400, 408, 300

[56] References Cited

U.S. PATENT DOCUMENTS

| | | | |
|---|---|---|---|
| 3,777,466 | 12/1973 | Kabele et al. | 57/408 X |
| 3,800,521 | 4/1974 | Doudlebsky et al. | 57/301 |
| 4,036,002 | 7/1977 | Kobayashi | 57/301 X |
| 4,041,687 | 8/1977 | Motobayashi et al. | 57/301 |
| 4,133,168 | 1/1979 | Keller et al. | 57/304 |
| 4,142,356 | 3/1979 | Hugges et al. | 57/304 X |
| 4,628,677 | 12/1986 | Turner et al. | 57/301 |
| 4,676,059 | 6/1987 | Artzt et al. | 57/408 X |

*Primary Examiner*—Donald Watkins
*Attorney, Agent, or Firm*—Barnes & Thornburg

[57] ABSTRACT

An open-end spinning machine is provided which includes a cleaning element movable between two rows of adjacently aligned spinning units. The cleaning device sucks away and removes impurities from a stationary collecting device associated with impurity separation openings in opening devices of the spinning units. The cleaning device includes at least one suction element that extends into the stationary collecting element for drawing the impurities into the cleaning device.

34 Claims, 8 Drawing Sheets

OPEN-END SPINNING MACHINE

BACKGROUND AND SUMMARY OF THE INVENTION

The invention relates to an open-end spinning machine having a plurality of spinning units that are arranged in a row adjacent to one another on each side of the machine and that each have an opening device for opening up fibers.

It is known Ger. Pat. No. 26 58 752) to arrange below the separation openings of the individual spinning units, a channel that passes through in longitudinal direction of the machine, which serves as a stationary collecting device for impurities. One or several conveying devices move in this channel that take the impurities along and lead them to a suction device that is connected to the channel. In this case, it is also known (FIG. 16) to slidably arrange a pneumatic travelling unit in the channel that, by means of a traction rope, is driven to perform a to-and-fro motion. This pneumatic travelling unit pushes the impurities in the channel along in front of the unit until a suction device is reached. It is also provided that this travelling unit, in the area of each spinning unit, connects itself automatically with a vacuum duct so that the removal by suction from the channel takes place via a cleaning element connected with the vacuum duct. Depending on the speed of the travelling unit, the removal by suction of the impurities takes place for only a relatively short time so that at least a part of the impurities is pushed along by the travelling unit in front of itself and is pushed past under the separation opening of the spinning unit that follows The danger exists that large amounts of impurities will collect that will be sucked into the spinning unit, via the separation opening of a spinning unit Accumulations of impurities of this type in the form of so-called clots result in a disturbance of the spinning process, i.e., in a defective point in the yarn or even in a yarn breakage.

It is also known Ger. Pat. No. 24 58 538) to provide a servicing carriage that drives around the open-end spinning machine and that, when it is applied to the individual spinning units, empties and cleans dirt collecting chambers Since a travelling unit must also drive around the open-end spinning machine on the outside that must carry out other servicing processes and particularly the piecing, only a very irregular cleaning cycle is obtained because the piecing must have priority because of the otherwise occurring production losses. If the two servicing units are combined into one unit, irregular cleaning cycles are also obtained. The danger will then exist that after the impurities are separated at the separation opening the time period before removal will be too long. The danger exists that accumulations of impurities will be sucked back via the separation opening, and will then interfere with the spinning process and result in defective points in the yarn or in a yarn breakage.

It is also known (Ger. Pat. No. 24 55 542) to combine two servicing units with a joint undercarriage that carry out servicing operations at two opposite spinning units, for example, piecing operations. In this case, it is also known to arrange these combined two servicing units so that they can be moved between two rows of spinning units of a spinning machine.

It is also known (rotor spinning machine "Autocoro" of W. Schlafhorst & Co., 4050 Moenchengladbach) to provide a movable servicing device that, for carrying out a piecing operation, can be applied to the individual spinning units. This servicing arrangement contains not only devices for the cleaning of the spinning rotor before a piecing operation, but also devices for the blowing-off of certain areas of the spinning unit. The impurities that are detached in this case, for example, fiber fly or the like, are not carried off in a controlled way. Therefore, the danger exists that these impurities may deposit at another point and may result in a disturbance at that point.

An object of the invention is to provide an open-end spinning machine such that an effective removal of the separated impurities is achieved without causing an increased energy consumption and without the danger that accumulations of dirt are sucked back into a spinning unit and/or are carried from one spinning unit to another.

This object is achieved by providing cleaning elements for sucking away and removing impurities which are arranged on the inside of the open-end spinning machine between two rows of spinning units and which contain at least one suction pipe. The at least one suction pipe extends to stationary collecting elements which collect impurities from the spinning units.

By means of this invention, the devices for the sucking away and removing of the impurities are arranged in a hitherto unutilized area, in which case the arrangement takes place in such a way that other servicing units are not interfered with. As a result, the required cleaning cycles can be maintained without the danger of inadmissible accumulations of separated impurities. Since the sucking away and removing of impurities always takes place only at one or only at a few points, the energy consumption that is required for this purpose can be kept relatively low. Constructive and mechanical expenditures are also relatively low.

According to other advantageous features of certain preferred embodiments of the invention, a carriage is provided as the device for the sucking away and removing of the impurities. The carriage includes a separation box and devices for generating a vacuum. In certain preferred embodiments, a stationary evacuation station is provided which is assigned for the separation box. As a result, an independent travelling unit is created that is not dependent on the other devices and that travels in an area that hitherto had not been utilized so that the functions of other travelling units are not impaired.

According to other advantageous features of certain preferred embodiments of the invention, it is provided that between the rows of the spinning units a vacuum duct is provided that extends in longitudinal direction of the machine and to which the devices for the sucking away and the removing of the impurities are permanently or continuously connected pneumatically. In certain embodiments of the invention, it is provided that the devices for the sucking away and the removing of the impurities including the at least one suction pipe can be moved in longitudinal direction of the machine at the vacuum duct, that is used for the carrying-away of the impurities, and is permanently pneumatically connected to it. The vacuum duct is therefore also used for the carrying-away of the impurities so that an evacuation station or the like is not needed. The suction pipes operate as an extension of the vacuum duct and periodically move past the collecting devices assigned to the separation openings, and in the process, carry away the impurities. Thus the technical expenditures are quite low and the energy consumption is also relatively low.

According to other advantageous features of certain preferred embodiments of the invention, it is provided that the devices for the sucking away and removing of impurities are driven by means of a circulating, continuous driving element. This results in a constructively simple drive that requires no significant control expenditures because the devices for the sucking away and removing of the impurities do not have to stop at the individual spinning units.

According to other advantageous features of certain preferred embodiments of the invention, it is provided that the devices for the sucking away and the removing of impurities are equipped with additional suction pipes that extend to other points of the spinning units that are to be cleaned. As a result, the special advantage is achieved that also a cleaning of the spinning units takes place in a back area that is hardly accessible to operating personnel, and therefore in many cases is not cleaned during the practical operation.

According to other advantageous features of certain preferred embodiments of the invention, it is provided that each spinning unit is equipped with a system including stationarily arranged suction pipes. When the devices for the sucking away and the removing of impurities move past, the stationary pipes can be pneumatically connected with the cleaning devices. As a result, it is also possible to periodically carry out cleaning operations at points of the individual spinning units that otherwise are hardly accessible.

According to advantageous features of certain preferred embodiments of the invention, the machine is constructed to largely prevent the danger of clogs being sucked into spinning units, while at the same time, the possibility exists that the individual spinning units together are cleaned effectively. In these embodiments, a servicing device is provided that can be moved along the open-end spinning machine on the outside on the operating side of the spinning units. For carrying out a piecing operation, the servicing device can be applied to a spinning unit, in which case devices for the coordinating of the servicing device and the devices for the sucking away and the removing of the impurities are provided by means of which both can be applied to the same spinning unit for the carrying out of a combined servicing operation.

By means of this combined servicing operation, it is possible to clean the spinning units very well, i.e., from the direction of the operating side and from the direction of the back side, in which case the impurities detached during the cleaning are received and carried away. Since the servicing arrangement that carries out a piecing operation becomes operative only after a yarn breakage, i.e., in the case of a spinning operation that is interrupted at the corresponding spinning unit, it is possible to carry out a very intensive cleaning operation. In certain preferred embodiments, this intensive cleaning operation includes using powerful air currents which cannot result in a reduction of the yarn quality because at this point in time, spinning does not take place at the concerned spinning point.

According to advantageous features of certain preferred embodiments of the invention, it is provided that the servicing arrangement is equipped with devices for the detaching of impurities that are located in or at a spinning unit. These impurities that are detached by the servicing arrangement will then be received and carried away by the cleaning devices arranged between the two sides of the machine.

According to advantageous features of certain preferred embodiments of the invention, it is provided that between the adjacent spinning units of each row, screens are provided. By means of these screens, the adjacent spinning units are partitioned off with respect to one another so that cleaning operations using strong currents of blown air can be carried out at the individual spinning units without disturbing adjacent spinning units. These screens that may, for example, be simple metal sheets, are developed in such a way that driving elements that pass through in longitudinal direction of the machine, such as tangential belts or shafts, can be guided through the sheets.

Other objects, advantages and novel features of the present invention will become apparent from the following detailed description of the invention when considered in conjunction with the accompanying drawings.

DETAILED DESCRIPTION OF THE DRAWINGS

Figure 1:
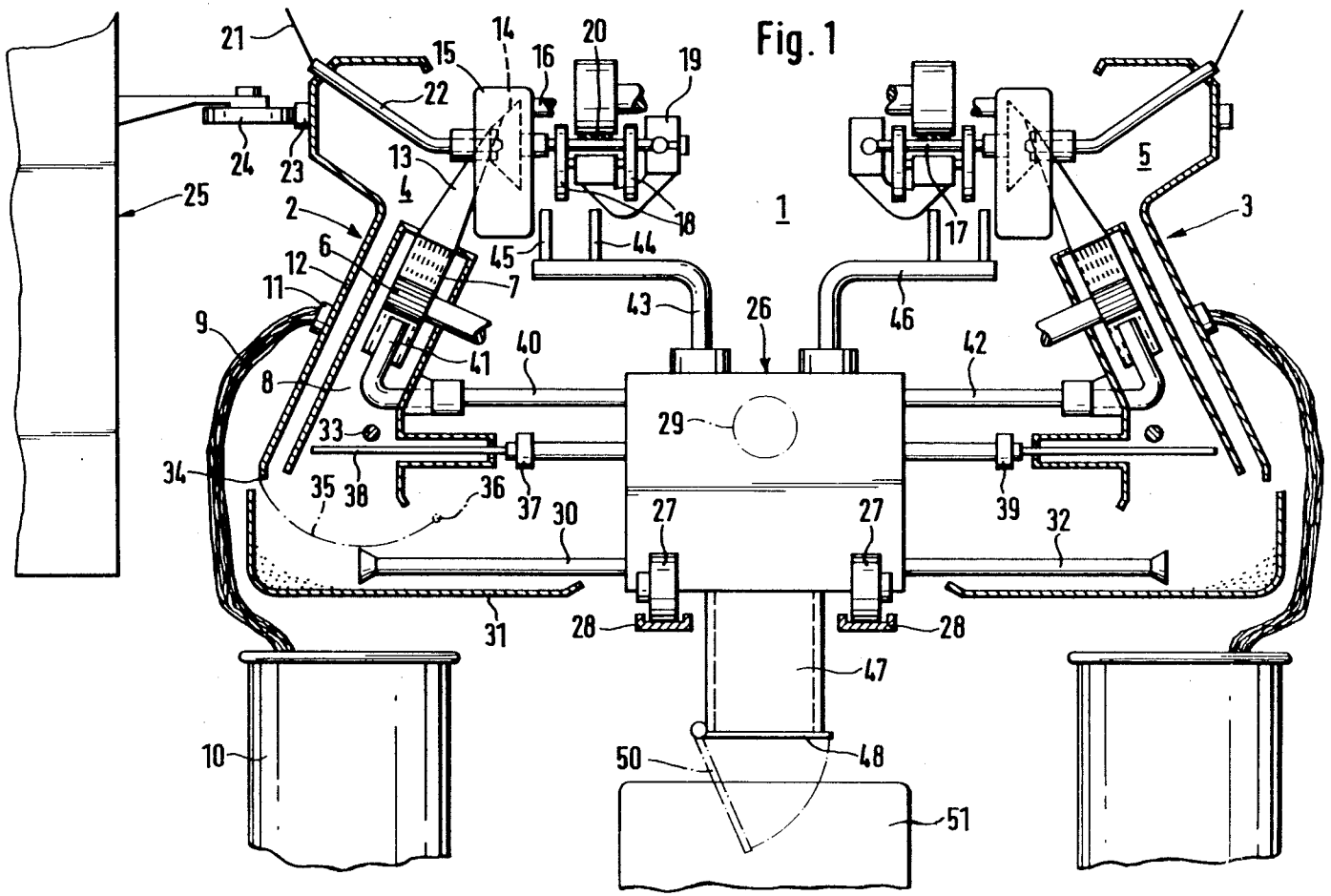
FIG. 1 is a cross-sectional diagrammatical view of an open-end spinning machine according to certain preferred embodiments of the invention, having devices that are constructed as a movable carriage for the sucking away and removing of impurities separated from the fiber material to be processed.

The open-end spinning machine 1 shown diagrammatically in FIG. 1 has two machine sides 2, 3 at which a plurality of spinning units 4, 5 are arranged in a row next to one another. In each spinning unit 4, 5, a sliver 9 is spun into a yarn 21. The sliver 9 is, in each case, taken from a can 10 that is placed below the spinning units 4, 5 and via an inlet 11 is guided into the spinning unit 4, 5. Each spinning unit 4, 5 contains a feeding and opening device, of which in FIG. 1 only one feeding roller 6 and one opening roller 7 are shown. The sliver 9 is opened up into individual fibers that, via a fiber feeding duct 13, are guided to a spinning rotor 14 in which the twisting-together of the deposited fibers into a yarn 21 takes place. The yarn is withdrawn from the spinning rotor 14, via a yarn withdrawal duct 22.

The spinning rotor 14 is arranged in a vacuum housing 15 that, via a suction connection 16, is subjected to a vacuum by means of a vacuum source that is not shown. By means of pairs of supporting disks 18 behind the vacuum housing 15, the shaft 17 of the spinning rotor 14 is supported and disposed in radial direction and the shaft 17 is supported in radial direction at a step bearing 19. The drive of the spinning rotor 14 takes place via a tangential belt 20 that also secures the spinning rotor 14 in a wedge-shaped gap that is formed by the pairs of supporting disks 18. The tangential belt 20 drives all shafts 17 of the spinning rotors 14 of the spinning units 4, 5 on one side of the machine 2, 3.

Each spinning unit 4, 5 is equipped with its own cover 12 covering each spinning unit in the direction of the operating side. This cover 12 can be swivelled around a swivelling axis 33 located below the feeding and opening device, extending in longitudinal direction of the machine. The shown operating position of the cover 12 is secured in a way that is not shown in detail. At this cover 12, individual driving rails 23 are arranged on which the running wheels 24 of a drivable servicing device 25 are supported. The drivable servicing arrangement 25 drives around the machine 1 on the outside and is used for carrying out piecing operations.

In the area of the feeding and opening devices, the spinning units 4, 5 are provided with separation openings 8 that are open in the direction of the opening roller 7 and through which the dirt particles, fiber nests or neps, or the like are separated. These impurities are detached during the opening up of the sliver 9 into individual fibers. The impurities that are separated by the separation openings 8 are collected by a channel or trough 31 passing through in longitudinal direction of the machine and arranged at a distance below the spinning units 4, 5. This channel 31 and the cover 12 with its bearing around the axis 33 are coordinated with one another in such a way that, when the cover 12 is swivelled away, its lower edge 34 moves on an arc 35 (shown by a dash-dot line) into position 36. In position 36, the cover 12, in the area of the respective spinning unit 4, 5, covers the channel 31 and the impurities collected on it. As a result, the servicing operations at a spinning unit 4, 5 that are carried out particularly by means of the drivable servicing device 25, which can operate with a vacuum if necessary, do not blow away the impurities collected on the channel 31.

Figure 12:
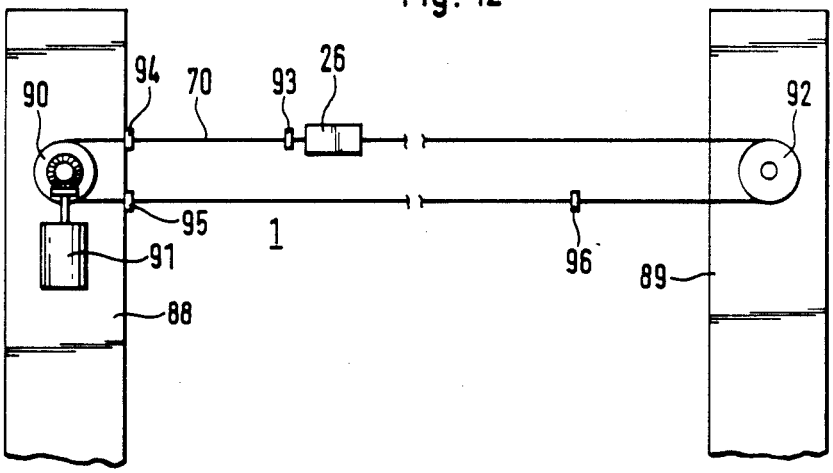
FIG. 12 is a diagrammatical view of certain preferred embodiments of a drive for the devices for the sucking away and removing of impurities.

The impurities that are collected by the channels 31 on both sides 2, 3 of the machine are removed from these channels 31 at regular intervals. For this purpose, a carriage 26 is provided in the center of the machine between the two sides 2, 3, that can be moved in longitudinal direction of the machine. The carriage 26 is arranged at least approximately at the level of the separation openings 8 of the spinning units 4,5. The carriage 26 is equipped with running wheels 27 that run on rails 28 extending in longitudinal direction of the machine. The carriage 26 is provided with a drive that is not shown and that together with it moves back and forth in longitudinal direction of the machine. In this case, the carriage 26 moves at a uniform constant speed without stopping at the individual spinning units 4, 5. For this purpose, the carriage 26 can receive its own driving motor or may be moved by means of a drive that moves back and forth, as will be explained in detail below (for example, as shown in FIG. 12).

The carriage 26 includes a separation box that is airtight with respect to the outside, and in which a suction fan 29 is arranged that contains an electric motor drive that is supplied with electricity in a way that is not shown in detail. Two suction pipes 30, 32 project away from the separation box of the carriage 26 in horizontal direction, and are guided closely above the channels 31 extending to the area of the channels in which the impurities are collected. As shown schematically in FIG. 1, brushing or scraping elements 150 can be included in the area of suction pipes 30, 32. The suction pipes 30, 32, at regular time intervals, pass by the individual spinning units 4, 5 so that the impurities collected there are carried away at regular intervals.

As shown in FIG. 1, the carriage 26 and the suction pipes 30 are arranged in such a way that particularly the operation of the servicing device 25 driving around the machine on the outside is not impaired. As shown in FIG. 1, the suction pipes 30 are located in an area below the swivel path 35 of the covers 12, so that when the spinning units 4, 5 are opened, the movability of the carriage 26 is not impaired. In order to prevent the suction pipes 30, 32 from having an affect back into the area of the separation openings 8 and thus possibly interfering with the spinning process, when the impurities are sucked off the channels 31 by means of suction air current, screens 38 are assigned to each spinning unit 4, 5. These screens 38 can be made of an essentially plate-shaped slide that can be slid in essentially horizontal direction transversely with respect to the separation opening 8. These screens 38 are held in the inoperative position, by means of a spring that is not shown, and by means of an actuating element 37, 39 of the servicing carriage 26 are moved to the screening position when the carriage 26 passes by the corresponding spinning unit 4, 5.

Two additional suction pipes 40, 42 project away from the separation box of the carriage 26 to each side 2, 3 of the machine. These suction pipes 40, 42 place themselves against a corresponding connection when the carriage 26 passes by a spinning unit 4, 5, and as a result, produce a suction air current in a suction pipe 41 that is stationarily arranged in the spinning unit 4, 5. In the case of the shown embodiment, the suction pipe 41 is in each case assigned to the feeding roller 6 of the spinning units 4,5.

The separation box of the carriage 26 is also equipped with additional suction pipes 43, 46 that project in upward direction and that by means of suction connection pieces 44, 45, are aimed at the area of the bearing of the spinning rotor 14 of the spinning units 4, 5. As a result, it is possible to also clean these areas pneumatically at regular intervals.

As a modification of the shown embodiment, it is contemplated that the pressure side of the fan 29 is connected with pressure lines that project particularly into the area of the bearings of the spinning rotors 14 of the spinning units 4, 5 and by means of which, in addition, a blowing-off of these areas is possible. It is also contemplated to mount additional cleaning elements at the carriage 26, such as brushes or rotating needles, that act as so-called flock catchers. It is therefore contemplated to clean particularly the rear areas of the spinning units 4, 5 at regular intervals that are normally not accessible to the operating personnel and are therefore cleaned very seldom.

The separation box of the carriage 26, which carries away the impurities received by it, is applied to a stationary evacuation station 51 that is located preferably in the area of one or of both machine ends. The separation box has a collection box 47 that is closed by a flap 48 that can be swivelled away. In the area of the evacuation station 51, the flap 48 is automatically opened and brought into position 50 (shown by dash dot lines) by devices that are not shown.

Figure 2:
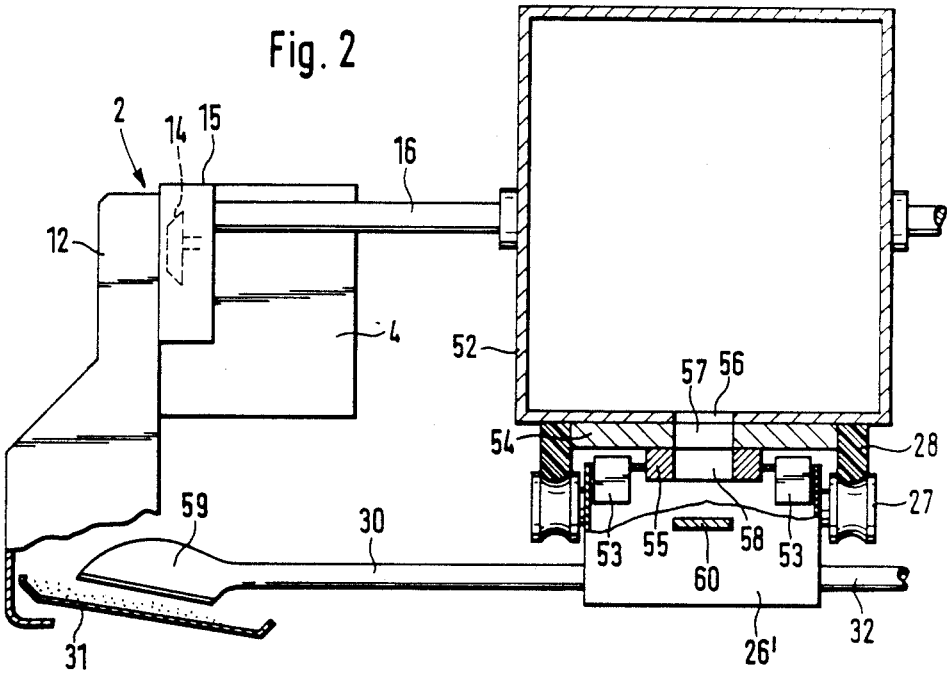
FIG. 2 is a partial cross-sectional view of another preferred embodiment of an open-end spinning machine, having a vacuum duct extending in longitudinal direction of the machine in which the devices for the sucking away and removing impurities are movably connected with the interior of the vacuum duct.

In the case of the embodiment according to FIG. 2, the open-end spinning machine 1 is also equipped with spinning units 4, 5 arranged in rows next to one another on both sides 2, 3 of the machine. The area of the center of the machine is equipped with a large-volume vacuum duct 52 that extends in longitudinal direction of the machine. This vacuum duct 52 is connected to a fan in the area of one end of the machine. The vacuum duct 52 is connected to the individual spinning units 4, 5 and vacuum housing 15 via suction lines 16. The vacuum duct 52 supplies the vacuum housing 15 of the individual spinning units 4, 5 with a vacuum.

At the underside of the vacuum duct 52, a connecting cleaning element 26' is guided that can be moved in longitudinal direction of the machine in the manner of a carriage. The underside of the vacuum duct 52 is equipped with a reinforcing plate 54, next to which rails **28*a* are arranged laterally that can be made of a material such as plastic particularly. On the rails 28*a*, rollers 27*a* of the connecting element 26' are guided that move against the rails 28*a* from below. The connecting element 26' is provided with permanent magnets 53 that face the reinforcing plate 54, and that pull the connecting element 26' toward the vacuum duct 52**.

The vacuum duct 52 is in permanent and continuous pneumatic connection with the connecting element 26'. For this purpose, the bottom of the vacuum duct 52 and the reinforcing plate 54 are provided with openings 56, 57 to which a connection component 55 of the connecting element 26' is assigned that has an opening 58. The connection component 55 is developed to be elastic in the direction of the reinforcing plate 54 (in a way that is not shown in detail), and slides at the reinforcing plate 54. The openings 57 of the reinforcing plate 54 are equipped with plate-shaped closing elements that, during the passing-by, are opened up by the connection component 55 that moves against them, and then subsequently close automatically. (For this connection operation, an embodiment will be discussed later shown in FIG. 7.)

Suction pipes **30*a*, 32*a* project away in horizontal direction toward both sides 2, 3 from the connecting element 26', that is located at the level of the undersides of the spinning units 4, 5. These suction pipes 30*a*, 32*a* pass over a channel 31*a* that is used as a device for collecting impurities that are separated from the spinning units 4, 5. The ends of the suction pipes 30*a*, 32*a* are developed as suction heads 59. These suction heads 59 are designed in such a way that a suction effect exists essentially only in direct proximity of the channels 31*a* so that the effect of the suction air current back into the area of the separation openings 8 of the individual spinning units 4, 5 is not possible. The impurities that are received by the suction heads 59 of the suction pipes 30*a*, 32*a* are introduced directly into the vacuum duct 52 via the connecting element 26', and are carried away by the vacuum duct 52. The connecting element 26' is driven to perform a uniform movement in longitudinal direction of the machine. The drive takes place via a tension member 60 that itself is driven and deflected in the area of the machine ends. This type of drive will be explained below, for example, in FIG. 12**.

Figure 4:
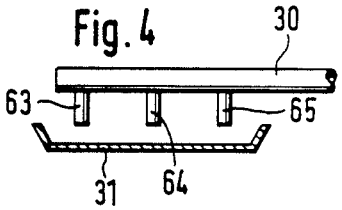
FIG. 4 is a schematic view of certain preferred embodiments of a suction head of a suction pipe of the devices for the sucking away and the removing of the impurities.

It is also contemplated to use different shapes and forms of suction heads 59 of the pipes **30*a*, 32*a* such as the arrangement that is shown in FIG. 4, for example. In this form, the suction heads 59 of the suction pipes 30*b*, 32*b* include individual suction nozzles 63, 64, 65 that are aimed at the channel 31*a***.

Figure 3:
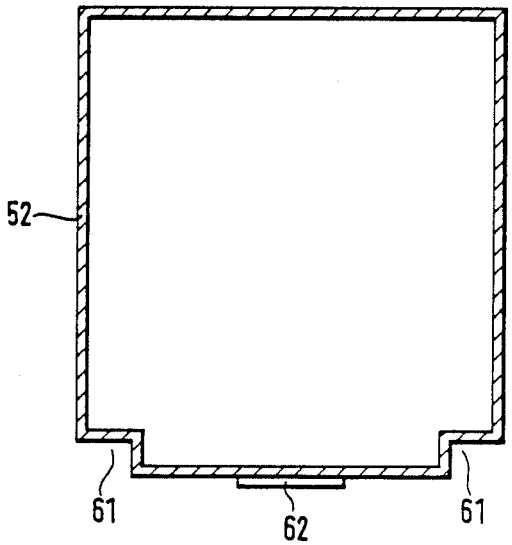
FIG. 3 is a cross-sectional view of certain preferred embodiments extending in longitudinal direction of the machine.

As a modification of the embodiment according to FIG. 2, it is contemplated that running wheels 27 of the connecting element 26' run directly on the bottom of the channel **52*a* without providing rails 28*a*. In this case, the vacuum duct 52*a* is advantageously made according to the embodiment of FIG. 3, in which, in the area of the lateral edges of the bottom of the vacuum duct 52*a*, contours 61 are provided that are used as a replacement of the running rails. In this case, a reinforcing plate 54 is not required so that the closing elements 62 are mounted directly at the duct bottom. (Such closing elements 62 will be discussed below in FIG. 7**.)

Figure 5:
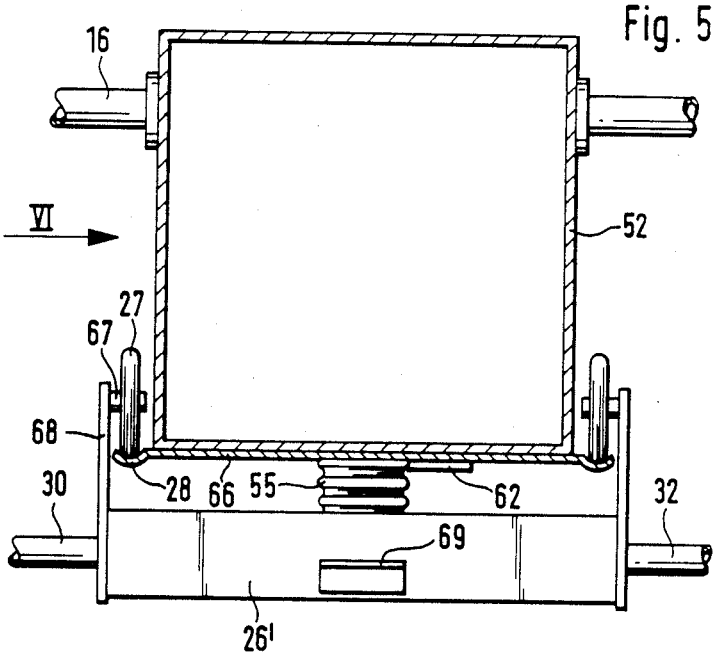
FIG. 5 is a partial cross-sectional view of another embodiment of the invention having devices for the sucking away and removing of impurities that are drivably suspended at the underside of a vacuum duct.
Figure 6:
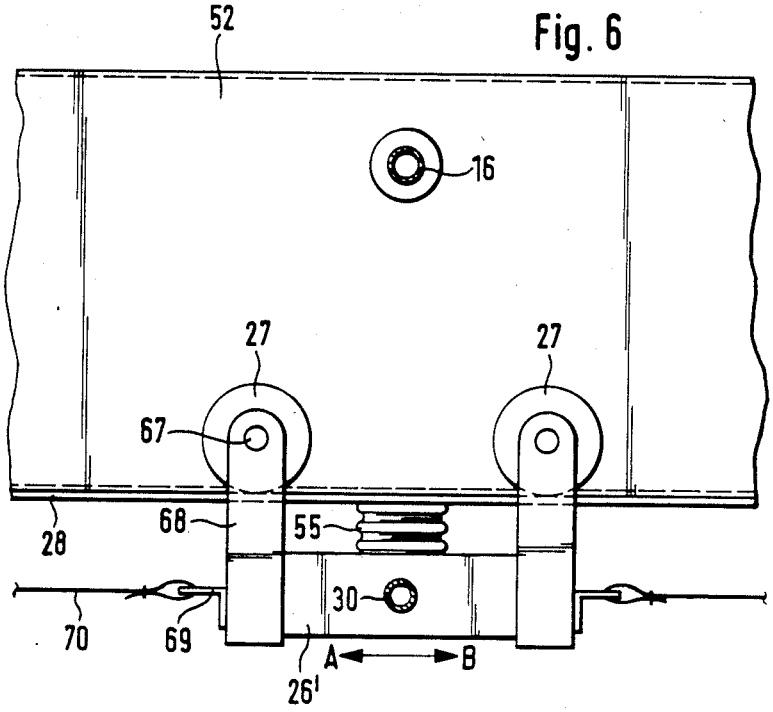
FIG. 6 is a partially cut view of the embodiment according to FIG. 5 in the direction of the Arrow VI.

Also in the case of the embodiment according to FIGS. 5 and 6, the connecting element 26' is developed as a type of carriage and runs directly at the underside of a vacuum duct 52. The vacuum duct 52 is connected to the vacuum housing 15 of the spinning units 4, 5 to supply a vacuum thereto. In this embodiment, the bottom of the vacuum duct 52 is reinforced by a plate 66 that projects laterally past the bottom of the vacuum duct 52 and with groove-shaped contours, forms running rails **28*b* for the running wheels 27*b* of the suspended running gear of the connecting element 26'. The connecting element 26' is equipped with laterally mounted brackets 68 from which axles 67 project for four running wheels 27***b*. In the case of this embodiment, the bottom of the vacuum duct 52 and the reinforcing plate 66 are provided with recesses that are closed off by closing flaps 62 that are opened up by an elastic connection component 55. In order to avoid wear of the connection component 55 and/or of the reinforcing plate 66, slide coatings are advantageously provided that are particularly made of plastic.

The connecting element 26' is driven to perform to-and-fro movements in longitudinal direction of the machine by a continuous traction rope 70 (direction of the arrows A and B shown in FIG. 6). The traction rope 70 is suspended in connection brackets 69 that are fastened at the connecting element 26'. The traction rope 70 may, for example, be driven corresponding to the embodiment according to FIG. 12 which will be discussed below.

Figure 7:
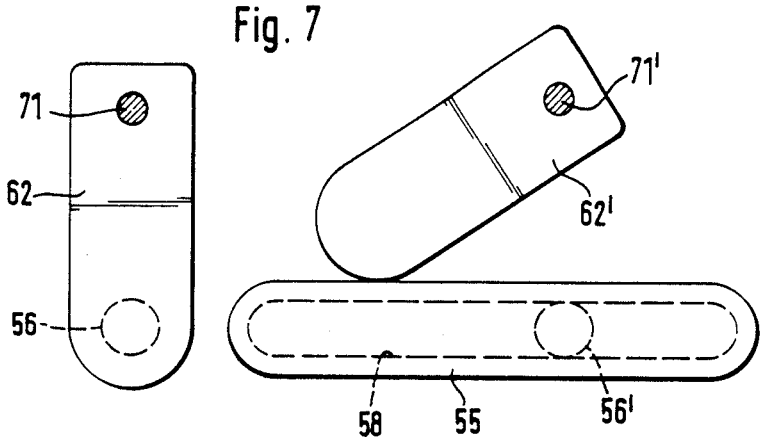
FIG. 7 is an enlarged view of an embodiment of the permanent pneumatic connection of the devices for the sucking away and the removing of impurities with a vacuum duct.

As mentioned above, the connecting element 26' is in continuous Pneumatic connection with the vacuum duct 52. For this purpose, the connection components 55 and the recesses 56 in the bottom of the vacuum duct 52 and possibly also in the reinforcing place 54 or in the plate 66 are developed in such a way that the connection component 55 continuously overlaps with at least one of these recesses 56 (FIG. 7). The connection component 55 has an oval shape pointing in longitudinal direction of the machine, the length of which is slightly larger than the distance between two recesses 56, 56' of the vacuum duct 52. The recesses 56, 56' are closed off by cover plates 62, 62' arranged on the outside at the vacuum duct 52. These cover plates 62, 62' can be swivelled around shafts 71, 71'. By means of springs that are not shown, the cover plates 62, 62' are brought into the closed position, and are moved out of this closed position by the connection component 55 that moves against them.

It is also contemplated to establish a continuous pneumatic connection between the vacuum duct 52 and the connecting element 26' in a different way. For example, it is possible to provide the vacuum duct 52 with a longitudinal slot that is closed off by means of strip-shaped sealing elements that, in particular, may overlap. The connection component 55 may engage in this longitudinal slot and establish the pneumatic connection, in which case the sealing elements close again automatically in front of and behind the connection component 55.

Figure 8:
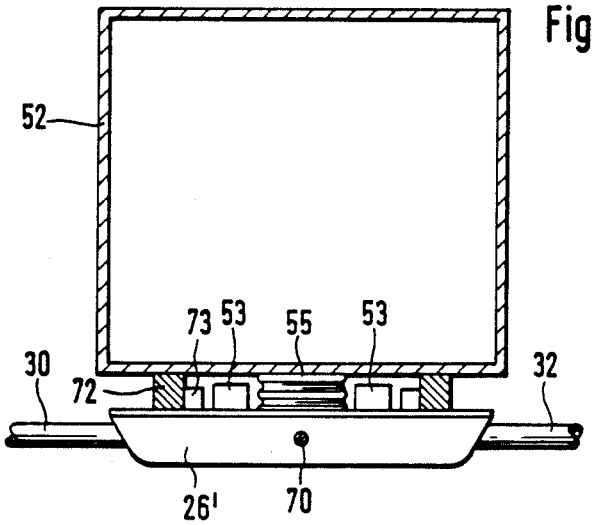
FIG. 8 is a partial cross-sectional view of another embodiment of the invention having devices for the sucking away and removing of impurities that are slidably held at the underside of a vacuum duct.

The embodiment according to FIG. 8 shows a further simplified construction for the guiding of the connecting element 26' at the bottom of a vacuum duct 52. The bottom of the vacuum duct 52 is equipped with two guide ledges 72 extending in longitudinal direction of the machine, at which the connecting element 26' is guided in a sliding way. Ledges 73 are mounted at the connecting element 26' that rest laterally against the guiding ledges 72 to provide lateral support of the connecting element 26'. By means of an appropriate selection of material and/or a coating, favorable sliding conditions can be achieved without difficulty that keep the sliding resistance low and largely prevent wear. In this embodiment, it is also provided that at the connecting element 26', permanent magnets 53 are mounted that attract the connecting element 26' in the direction toward the bottom of the vacuum duct 52. This type of arrangement is possible without presenting difficulties because the connecting element 26', including the suction pipes 30, 32, has a relatively low weight, for example of a magnitude of about only 3 kg. Also in this case, the connecting element 26' is driven by a traction rope 70 as shown in FIG. 6.

Figure 9:
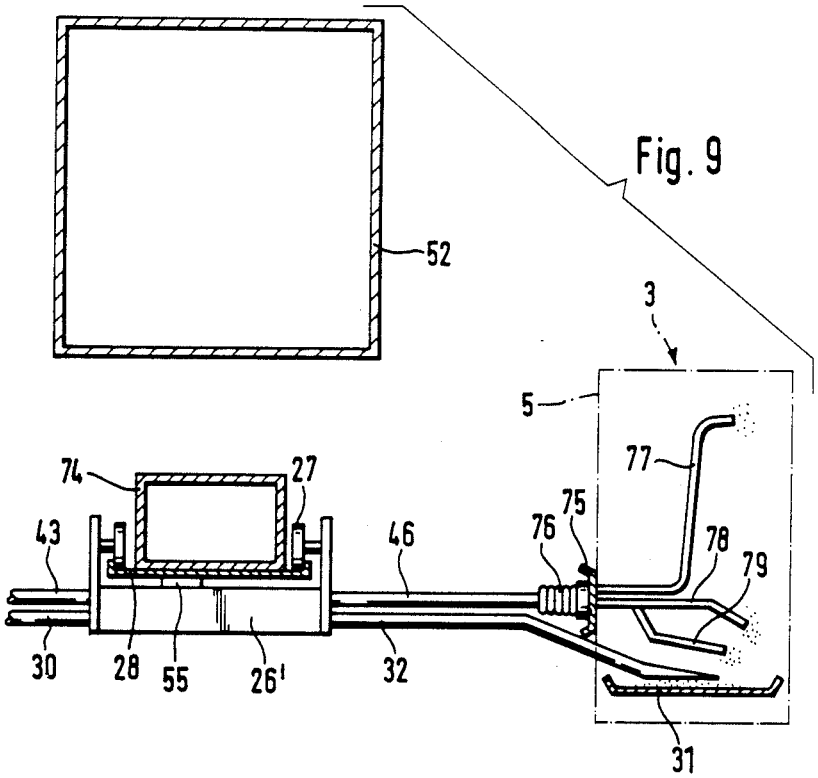
FIG. 9 is a partial cross-sectional view of another embodiment of a vacuum duct that is provided for the devices for the sucking away and removing of impurities which extends in longitudinal direction of the machine.

In practice, it may happen that for the sucking-off and carrying-away of the impurities separated at the opening devices, a different suction air flow is advantageous than required for the air located in the vacuum housings 15 of the spinning units 4, 5. As shown in FIG. 9, for such conditions, it is advantageous to provide a separate vacuum duct 74 for the carrying-away of impurities and also for the guiding of the connecting element 26', in addition to the conventionally existing vacuum duct 52*b* that ensures the supply of the vacuum housing 15.

In this case, a separate vacuum duct 74 is provided for the connecting element 26' that extends in longitudinal direction of the machine arranged independently of the other vacuum duct 52*b* and that is equipped with its own vacuum source in the form of a fan. It is contemplated to guide the connecting element 26' on vacuum duct 74 similar to any of the embodiments of the invention of the connecting element 26' being guided on vacuum duct 52, 52*a*. In this case, it is also contemplated to arrange the vacuum duct 74 with respect to the height in such a way that the suction pipes 32 are directed essentially horizontally, while the connecting element 26' is guided on the top side of the vacuum duct 74. In the embodiment according to FIG. 9, the connecting element 26' is formed and guided in a way that is similar to FIG. 5.

In addition to the suction pipes 30, 32 that extend toward the channels 31, other suction pipes 43, 46 are connected to the connecting element 26' that in each case are aimed at one side 2, 3 of the machine. Assigned to these suction pipes 43, 46, in each spinning unit 4, 5, are stationarily placed suction pipes 77, 78, 79 that are guided to additional points to be cleaned, that are not accessible in the case of a movement in longitudinal direction of the machine. The stationary suction pipes 77, 78, 79 of the individual spinning units 4, 5 start at a connection ledge 75 that extends in longitudinal direction of the machine and along which the suction pipes 46 are guided with an elastic suction projection 76.

Figure 10:
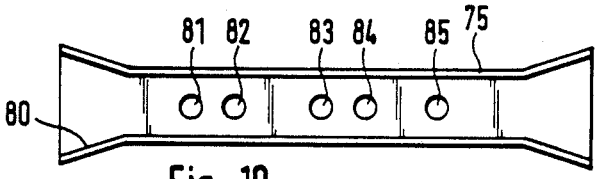
FIG. 10 is an enlarged view of a detail of the embodiment according to FIG. 9.

As shown in FIG. 10, the connections 81 to 85 of the stationary suction pipes 77, 78, 79 are offset behind one another in longitudinal direction of the machine so that the connection piece 76, in each case, covers only one or only two of these connection openings 81 to 85 at a time. As a result, the air consumption can be limited. The connecting ledges 75 may include partial sections that each extend only over the width of one spinning unit 4, 5 and that are provided with centering slopes 80 in which the connection piece 76 is centered during the passing-by at the corresponding spinning unit 4, 5.

Figure 11:
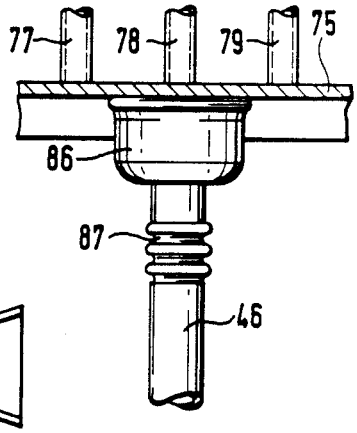
FIG. 11 is a partial cross-sectional view of the connection of the pipes shown in FIG. 10 connected to the devices for the sucking away and removing of impurities.

According to FIG. 11, it is also contemplated to let the stationary suction pipes 77, 78, 79 lead out into a continuous guide rail in which a connection piece 86 of the suction pipes 43, 46 is guided. In this case, at any arbitrary point of the suction pipes 46, an elastic intermediate part 87 may be provided in order to ensure a sealing contact of the connection piece 86 at the connecting ledge 75.

As schematically shown in FIG. 12, a drive for a servicing carriage 26 is contemplated that is also suitable to be used as a drive for a connecting element 26'. The servicing carriage 26 is driven by a rope 70 or a tension member that is coupled with the servicing carriage. In the area of the machine ends, i.e., of the drive boxes 88, 89, the rope 70 is guided via deflecting rollers 90, 92. One of the deflecting rollers 90 is driven by an electric motor 91. The electric motor 91 is equipped with reversing switches 94, 95 to which are assigned stops 93, 96 mounted at the rope or the tension member. As soon as one of the stops 93, 96 moves against a reversing switch 94, 95, the driving direction of the electric motor 91 is reversed.

As a modification of the embodiment according to FIG. 12, it is also contemplated to provide a drive by means of a tension member, rope or chain that continuously moves around in only one direction and drives the carriage 26 or the connecting elements 26' to perform a to-and-fro movement. In this case, it is provided that the circulating driving element, such as a traction rope 70 is equipped with a driving bolt that engages in a connecting link of the carriage 26 or of the connecting element 26' that has a recess extending transversely to the moving direction over the distance of both ends of the traction element. The bolt disconnects as it circles around the rollers and engages again to return the carriage in the opposite direction.

It is also contemplated that the carriage 26 or the connecting elements 26' need not necessarily be assigned to both sides 2, 3 of the machine, i.e., must have suction pipes 30, 32 that are directed at both sides 2, 3 of the machine or, if necessary, have additional suction pipes. Particularly for constructional reasons, it may become necessary to provide two carriages 26 or the connecting elements 26', and assign them to only one respective side 2, 3 of the machine. This case may occur when, for example, central columns 97 are Provided in the center of the machine, as shown, for example, in FIG. 13.

Figure 13:
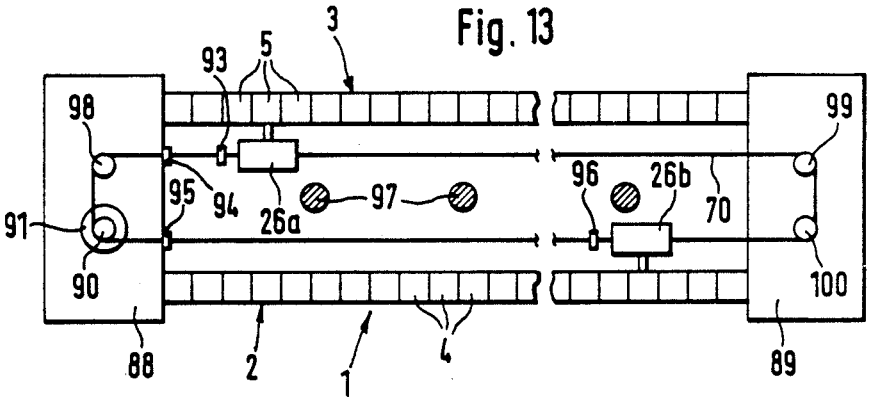
FIG. 13 is a top diagrammatical view of certain preferred embodiments of the open-end spinning machine having two devices for the sucking away and removing of impurities that are each assigned to one side of the machine.

In the embodiment of FIG. 13, carriages 26*a*, 26*b* are provided that are each assigned to only one side 2, 3 of the machine and to the spinning units 4, 5 located on that side. The corresponding situation naturally also applies to the arrangement of connecting elements 26' for which, if necessary, two vacuum ducts are also provided. Also, for the two carriages 26*a*, 26*b* a joint drive is provided in the form of a traction rope 70. In the drive boxes 88, 89 of the open-end spinning machine 1, deflecting rollers 90, 98, 99, 100 are provided that deflect each of the two ends of the traction rope 70 parallel to the two sides 2, 3 of the machine. The deflecting roller 90 is provided with a driving motor 91 that is connected to reversing switches 94, 95 to which stops 93, 96 are assigned.

It is also contemplated to give the carriage 26 or the connecting elements 26' other functions, in addition to the cleaning function. It is contemplated to check the bearing of the spinning rotors 14 by means of suitable devices when passing by the spinning units 4, 5. In the case of bearing disturbances that result in an off-center run of the spinning rotors 14, vibrations occur in the area of the step bearings 19 that generate a noise. This noise can be received by a control microphone that is guided directly past the step bearings 19. This noise is unique such that it can be filtered out of the other noises. Also, for the same purpose, vibration detections may be carried out that are either contactless or operate by means of a contact. In connection with a signal transmitter that detects the respective position of the servicing carriage 26 or of the connecting elements 26', a bearing damage of a certain spinning unit 4, 5 can be indicated.

Figure 14:
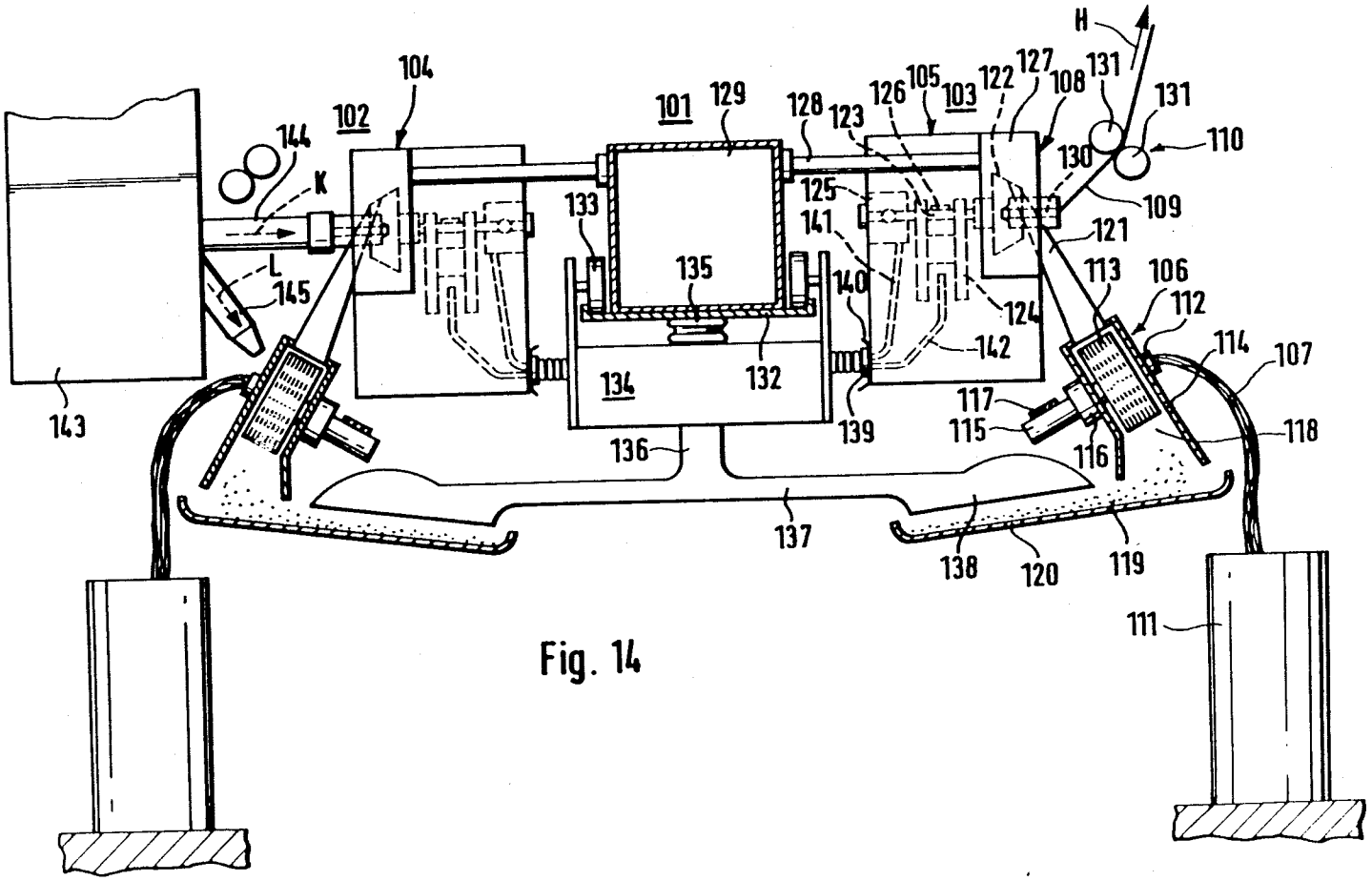
FIG. 14 is a partial cross-sectional schematic view of the invention including movable devices operating simultaneously at the front side and at the back side.

Each side of the open-end rotor spinning machine 101 shown in FIG. 14 is equipped with a row 102, 103 of spinning units 104, 105 that are arranged next to one another. Each spinning unit 104, 105 contains a feeding and opening device 106, a spinning element 108, a withdrawal device 110 and a wind-up device that is not shown by which the spun yarn 109 is wound up to a cross-wound spool.

A sliver 107 that is to be spun is taken from a spinning can 111 and, via an inlet guide 112, is guided to a feeding roller of the feeding and opening device 106. The feeding roller that is not shown offers the sliver 107 to a considerably faster running opening roller 113 that combs the sliver 107 out into individual fibers. The opening roller 113 is disposed in an opening roller housing 114 in a bearing projection 116. The shaft 115 of the opening roller 113 projects out of the bearing projection 116 and is driven by a tangential belt 117 moving through in longitudinal direction of the machine. Each opening roller housing 114 is provided with a separation opening 118 that is located opposite the circumference of the opening roller 113 and through which the impurities 119 that are contained in the sliver 107 are separated. The impurities 119 fall on a groove-shaped dirt collecting trough or channel 120 that extends in longitudinal direction of the machine and that is guided past all separation openings 118 of the spinning units 104, 105 of the corresponding side 102, 103 of the machine.

The individual fibers, via a fiber feeding duct 121 starting at the opening roller 113, are fed to the spinning element 108 such as a spinning rotor 122 as illustrated in the shown embodiment. In the spinning rotor 122, the yarn 109 is spun which is withdrawn via a yarn withdrawal duct 130. The spinning rotor 122 is equipped with a shaft 123 that is disposed outside a rotor housing 127 in the wedge-shaped gaps of pairs of supporting disks 124. The shaft 123 is supported in axial direction by a step bearing 125. A tangential belt 126 moves directly against the shaft 123. This belt 126 drives the shaft 123 and also holds the shaft in the wedge-shaped gaps of the pairs of supporting disks 124 during the operation. The rotor housing 127, via a vacuum line 128, is connected to a vacuum duct 129 that is located in the center of the machine. The vacuum duct 129 passes through in longitudinal direction of the machine and at one end is connected with a suction fan. The spun yarn 109 is withdrawn via a pair of withdrawal rollers 131, after which it moves in the direction of the arrow H to the wind-up device that is not shown.

The suction duct 129 that extends in the center of the machine is equipped with a carriage way 132 at its underside for the running wheels 133 of a movable cleaning carriage 134. The cleaning carriage 134 can therefore be moved in the center between the two rows 102, 103 of spinning units 104, 105. The cleaning carriage 134 includes a suction box that is in a permanent or continuous air-conducting connection with the suction duct or the vacuum duct 129, via a connection 135 that is shown only diagrammatically. The vacuum duct 129 may, for example, be provided with a longitudinal slot that is closed off with overlapping, strip-shaped sealing elements, through which the connection 135 of the cleaning carriage 134 enters and establishes the pneumatic connection.

The cleaning carriage 134, via a connecting piece 136, is connected with two suction tubes 137 that end in suction heads 138. The suction heads 138 stroke over the dirt collecting trough 120 when the cleaning carriage 134 is moved. The cleaning carriage 134 is provided with a drive that is not shown and that may include, for example, a running gear driving the running wheels 133 or a rope drive or belt drive that runs in longitudinal direction of the machine and is powered by a stationary driving motor. The cleaning carriage 134 is advantageously driven in such a way that it moves back and forth continuously in the center of the machine. In this case, the speed may be adjusted in such a way that it passes by the individual spinning units 104, 105 at an approximate three minute cycle. As a result, the impurities 119 that are separated from the spinning units 104, 105 in the area of the separation openings 118 are continuously sucked up and removed by the cleaning carriage 134.

The cleaning carriage 134 also has lateral connections 139 that are assigned to connection ledges 140 of the spinning units 104, 105. These connection ledges 140 are connected with connection openings to stationary suction pipes 141, 142 that extend within the spinning units 104, 105 and lead to the areas of the spinning units 104, 105 that are to be cleaned. The function of the connections 139 will be explained below.

In addition, the open-end rotor spinning machine 101 is equipped with a movable servicing apparatus 143 that, in a known way, is developed as a piecing arrangement. The movable servicing apparatus 143 moves on a carriage way of the open-end rotor spinning machine 101 in a way that is not shown in detail. This movable servicing apparatus 143 patrols along the spinning units 104, 105 of one or both sides 102, 103 of the machine and, when it determines a yarn breakage or after a preset program (preventive cleaning), carries out a piecing process at a spinning unit 104, 105. Since this piecing process and the required elements are generally known, they are not explained herein. In the case of this piecing process, a cleaning of the spinning rotor 122 also takes place.

The servicing apparatus 143 is also equipped with devices for the detaching of impurities at the individual spinning units 104, 105, that are developed as compressed-air blowing nozzles 144, 145 which can be applied to certain areas of the spinning units 104, 105, and which blow compressed-air currents in the direction of the arrows K and L into the serviced spinning unit 104, 105.

The servicing apparatus 143, by means of a program or by means of a signal indicating a yarn breakage, receives the information that it must carry out a servicing operation at the corresponding spinning unit 104, 105. This signal is also supplied to the drive of the cleaning carriage 134 that will then stop at the same spinning unit 104, 105 to which the servicing arrangement 143 is applied. The signal that leads to the stopping of the cleaning carriage 134 at a spinning unit 104, 105 is advantageously also utilized for then applying the connection 139 to the connection ledge 140 of the concerned spinning unit 104, 105. In this case, during this operation, it is also advantageous to close the suction pipe 137 that is assigned to the opposite spinning unit 104, 105.

Figure 15:
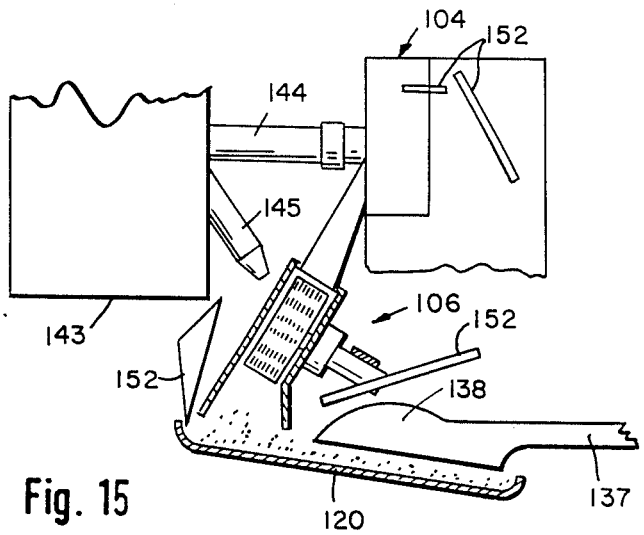
FIG. 15 is a schematic view of devices used for deflecting blowing air currents and/or detached impurities according to certain embodiments of the invention.
Figure 16:
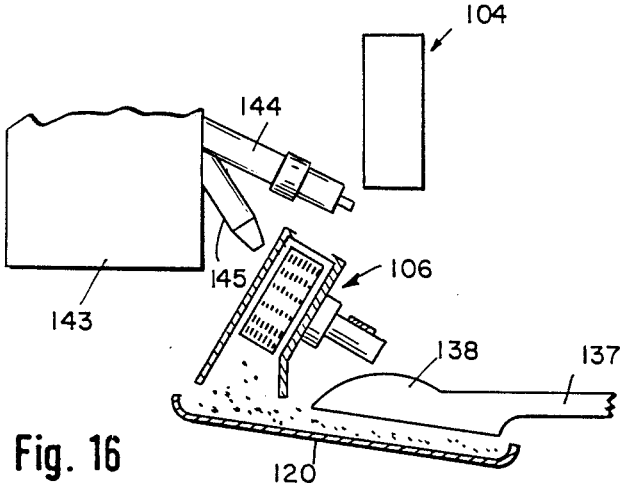
FIG. 16 is a schematic view of a possible arrangement of devices blowing air into the spinning units according to certain preferred embodiments of the invention.

During the cleaning, the impurities detached by the compressed-air nozzles 144, 145 are blown transversely through the spinning unit 104, 105 which is equipped with air-conducting means or the like or with correspondingly shaped levers or bearing parts that direct the air and the impurities downward to the dirt collecting channel 120. According to certain preferred embodiments, these elements 152 are shown schematically in FIG. 15. Further, in certain preferred embodiments, the compressed-air nozzles 144, 145 are directed toward the collecting channel 120 as schematically shown in FIG. 16. The impurities are removed from the trough 120 by the cleaning carriage 134. In addition, it is also contemplated to automatically turn the suction head 138 of the corresponding suction pipe 137 in upward direction when the cleaning carriage 134 stops at a spinning unit 104, 105 for carrying out the combined cleaning. The suction ducts 141, 142, which are only shown diagrammatically, are also used for collecting the detached impurities. Several of these suction ducts may exist. When the combined cleaning process is completed, the servicing apparatus 143 will carry out the piecing operation. The operation of the cleaning carriage 134 and the servicing apparatus 143 can be coordinated by a connection of each to a common control device 154 shown schematically in FIG. 14. The servicing apparatus 143 and the cleaning carriage 134 will then take up their usual patrolling operations.

When the machine is started, the usual approach is that the servicing apparatus 143 successively services and carries out a piecing process at all spinning units 104, 105. In this case of the starting of the machine, it may be provided that the cleaning carriage 134 coupled with the servicing apparatus 143 is controlled in such a way that both are applied in steps to the individual spinning units 104, 105. The procedure can be controlled by the schematically shown control device 154.

Figure 17:
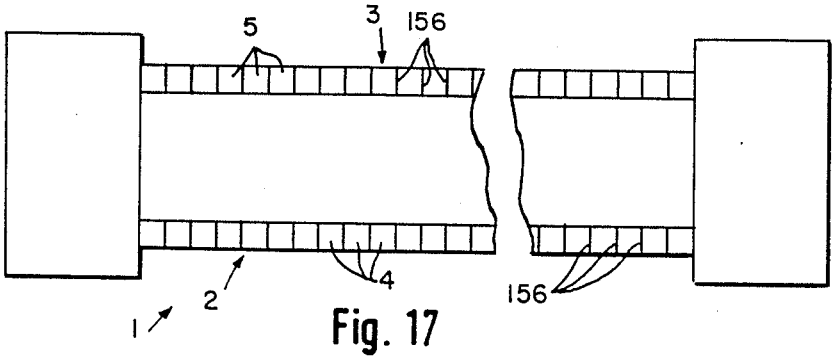
FIG. 17 is a schematic view of screening off devices between adjacent spinning units according to certain preferred embodiments of the invention.

In order to protect the adjacent spinning units 104, 105 from these air currents during the intensive cleaning of the whole spinning unit 104, 105, which is contemplated to also be carried out with more than two compressed-air nozzles 144, 145, protective screen plates are arranged between adjacent spinning units 104, 105 of each row 102, 103. These screen plates are schematically shown in FIG. 17. These Protective screen plates are constructed such that the elements moving through in longitudinal direction of the machine, such as the tangential belts 117, 126 and the shafts that pass through, can be guided through the protective screen plates. In this case, it should be observed that the protective screen plates are slotted in such a way that the inserting of the tangential belts 117, 126 is not impaired.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Open-end spinning machine, comprising:

a first row of a plurality of spinning units adjacently aligned in a longitudinal direction of said machine;

a second row of a plurality of spinning units adjacently aligned in said longitudinal direction and spaced from said first row with the spinning units of said second row facing away from the spinning units of said first row, each of said spinning units including an opening device for opening up individual fibers from a sliver, each of said opening devices including an impurity separation opening;

stationary collecting means associated with impurity separation openings for collecting any impurities from said spinning units; and cleaning means for sucking away and removing said impurities from said stationary collecting means, said cleaning means being disposed between said first row and said second row and being movable in said longitudinal direction, said cleaning means including at lease one suction means that extends to said stationary collecting means at the spinning units of both said first and second rows for drawing said impurities into said cleaning means.

2. Apparatus as in claim 1, wherein said cleaning means include at least one carriage having a separation box and vacuum means for generating a vacuum.

3. Apparatus as in claim 2, further including stationary evacuation means associated with said carriage for receiving said removed impurities from said carriage.

4. Apparatus as in claim 2, wherein said cleaning means include at least one carriage for cleaning said first row of spinning units and at least one separate carriage for cleaning said second row of spinning units.

5. Apparatus as in claim 1, wherein said cleaning means include at least two suction pipes that are arranged opposite one another, at least one of said at least two suction pipes being assigned to said first row and at least one opposite pipe of said at least two suction pipes being assigned to said second row.

6. Apparatus as in claim 1, further including a vacuum duct extending in said longitudinal direction in between said first row and said second row, said cleaning means being constantly pneumatically connected to said vacuum duct.

7. Apparatus as in claim 6, wherein at least one suction pipe is continuously pneumatically connected to said vacuum duct as said cleaning means moves along said first row and said second row, said at least one suction pipe thereby drawing said impurities away from said stationary collecting means.

8. Apparatus as in claim 6, wherein said cleaning means include a connecting element that is pneumatically connected with said vacuum duct, at least one suction pipe projecting out from connecting element.

9. Apparatus as in claim 8, wherein said connecting element includes an intermediate leading duct connecting said connecting element to said vacuum duct.

10. Apparatus as in claim 1, wherein said cleaning means are driven by means of a circulating, continuously driving element.

11. Apparatus as in claim 1, wherein said cleaning means includes at least one suction pipe is equipped with a suction head containing a suction nozzle means.

12. Apparatus as in claim 11, wherein said cleaning means include at least one of brushing and scraping means in the area of said at least one suction pipe.

13. Apparatus as in claim 1, further including screening means at each spinning unit for screening off the stationary collecting means with respect to said opening device, said screening means being adjustably mounted between a screened-off position and an open position.

14. Apparatus as in claim 13, wherein said cleaning means adjust said screening means from said open position to said screened-off position when moved past said screening means such that impurities are prevented from entering said opening device from said collecting means in said screened-off position.

15. Apparatus as in claim 1, wherein said cleaning means include screening means for screening-off the area of the separation openings with respect to the corresponding stationary collecting means.

16. Apparatus as in claim 1, wherein said cleaning means include additional suction pipes that extend to predetermined areas of the spinning units to be cleaned.

17. Apparatus as in claim 1, further including stationarily arranged suction pipes at each spinning unit directed to predetermined areas of each spinning unit to be cleaned, said cleaning means including means for pneumatically connecting to said stationary pipes when said cleaning means moves past said stationary pipes.

18. Apparatus as in claim 1, further including:

a movable servicing device movable around said first and second rows of spinning units on an outside longitudinal side opposite the side in between said first row and said second row, said movable servicing device carrying out piecing operations at said spinning units; an coordinating means for coordinating said movable servicing device and said cleaning means such that both said movable servicing device and said cleaning means operate in a coordinated manner at a given spinning unit.

19. Apparatus as in claim 18, wherein said movable servicing device includes detaching means for detaching impurities located at a spinning unit.

20. Apparatus as in claim 19, wherein said spinning units include deflecting means for deflecting said detached impurities toward said stationary collecting means.

21. Apparatus as in claim 19, wherein said detaching means include air blowing means for generating at least one blowing air current directed into a spinning unit.

22. Apparatus as in claim 21, wherein said spinning units include deflecting means for deflecting at least one of said detached impurities and said blowing air currents toward said stationary collecting means.

23. Apparatus as in claim 21, wherein said air blowing means are directed toward said stationary collecting means.

24. Apparatus as in claim 18, further including screening means disposed in between adjacent spinning units of each of said first row and said second row of spinning units for screening-off said spinning units from one another.

25. Apparatus as in claim 18, further including stationary cleaning pipe means at each spinning unit directed into predetermined areas of said spinning unit to be cleaned, said cleaning means being pneumatically connected to said stationary pipes when said cleaning means passes by said pipes.

26. Apparatus as in claim 1, further including screening means disposed in between adjacent spinning units of each of said first row and said second row of spinning units for screening-off said spinning units from one another.

27. Apparatus as in claim 1, further comprising impurity control means for preventing impurities from entering said opening devices of said spinning units from said collecting means during operation of said cleaning means.

28. Apparatus as in claim 27, wherein said impurity control means is disposed on at least one of said cleaning means and said plurality of spinning units.

29. Apparatus as in claim 1, further including at least one movable servicing device separate from said cleaning means movable to said spinning units, said at least one movable servicing device carrying out piecing operations at said spinning units, said cleaning means and said movable servicing device operating such that both said cleaning means and said movable servicing device can be simultaneously operated at a given single spinning unit.

30. Apparatus for open-end spinning machines of the type including a first row of a plurality of spinning units adjacently aligned in a longitudinal direction of said machine, a second row of a plurality of spinning units adjacently aligned in said longitudinal direction and spaced from said second row with the spinning units of said second row facing away from the spinning units of said first row, an opening device for opening up individual fibers from a sliver, an impurity separation opening in each of said opening devices, and stationary collecting means associated with said impurity separation opening for collecting any impurities from said spinning units, said apparatus comprising:

cleaning means for sucking away and removing said impurities from stationary collecting means, said cleaning means being disposed between said first row and said second row and being movable in said longitudinal direction, said cleaning means including at least one suction means that extends to said stationary collecting means at the spinning units of both said first and second rows for drawing said impurities into said cleaning means.

31. Apparatus for open-end spinning machine, comprising:

a first row of a plurality of spinning units adjacently aligned in a longitudinal direction of said machine;

a second row of a plurality of spinning units adjacently aligned in said longitudinal direction and spaced from said first row;

each of said spinning units including an opening device for opening up individual fibers from a sliver, each of said opening devices including an impurity separation opening;

stationary collecting means associated with said impurity separation opening for collecting any impurities from said spinning unit;

cleaning means for sucking away and removing said impurities from said stationary collecting means, said cleaning means being disposed between said first row and said second row and being movable in said longitudinal direction, said cleaning means including at least one suction means that extends to said stationary collecting means for drawing said impurities into said cleaning means, and a vacuum duct extending in said longitudinal direction in between said first row and said second row, said cleaning means being constantly pneumatically connected to said vacuum duct.

32. Apparatus as in claim 30, wherein at least one suction pipe is continuously pneumatically connected to said vacuum duct as said cleaning means moves along said first row and said second row, said at least one suction pipe thereby drawing said impurities away from said stationary collecting means.

33. Apparatus as in claim 31, wherein said cleaning means include a connecting element that is pneumatically connected with said vacuum duct, at least one suction pipe projecting out from said connecting element.

34. Apparatus as in claim 31, wherein said connecting element includes an intermediate leading duct connecting said connecting element to said vacuum duct.

* * * * *